US005942959A

United States Patent [19]

Kubo et al.

[11] Patent Number: 5,942,959

[45] Date of Patent: Aug. 24, 1999

[54] FILTER DEVICE HAVING A DIELECTRIC RESONATOR AND A COUPLING LOOP WITH ADJUSTABLE COUPLING BETWEEN THE DIELECTRIC RESONATOR AND THE COUPLING LOOP

[75] Inventors: Hiroyuki Kubo, Nagaokakyo; Eiichi Kobayashi, Mukou, both of Japan

[73] Assignee: Murata Manufacturing Co., ltd., Japan

[21] Appl. No.: 08/959,810

[22] Filed: Oct. 29, 1997

[30] Foreign Application Priority Data

Oct. 30, 1996 [JP] Japan ..... 8-288526

[51] Int. Cl.[6] ..... H01P 7/10

[52] U.S. Cl. ..... 333/202; 333/219.1

[58] Field of Search ..... 333/202, 219, 333/219.1, 230

[56] References Cited

U.S. PATENT DOCUMENTS

| | | | |
|---|---|---|---|
| 4,578,655 | 3/1986 | Etienne et al. | 333/202 |
| 5,157,363 | 10/1992 | Puurunen et al. | 333/202 |
| 5,684,438 | 11/1997 | Cavalieri D'Oro et al. | 333/219.1 X |
| 5,708,404 | 1/1998 | Kurisu et al. | 333/219.1 X |
| 5,764,115 | 6/1998 | Hattori et al. | 333/219.1 X |

FOREIGN PATENT DOCUMENTS

| | | | |
|---|---|---|---|
| 209787 | 1/1987 | European Pat. Off. | 333/202 |
| 61-136301 | 6/1986 | Japan | 333/202 |
| 63-299602 | 12/1988 | Japan | 333/219.1 |
| 6-85504 | 3/1994 | Japan | 333/202 |
| 7-94918 | 4/1995 | Japan | 33/230 |

OTHER PUBLICATIONS

Patent Abstracts of Japan, vol. 96, No. 7, Jul. 31, 1996 & JP 08 084008 A (Murata Mfg Co Ltd), Mar. 26, 1997, abstract.

Patents Abstracts of Japan, vol. 13, No. 136 (E–737), Apr. 5, 1989 & JP 63 299602 A (Murata Mfg Co Ltd), Dec. 7, 1988, abstract.

Patents Abstracts of Japan, vol. 95, No. 7, Aug. 31, 1995& JP 07 094918 A (Murata Mfg Co Ltd), Apr. 7, 1995, abstract.

Patent Abstracts of Japan, vol. 96, No. 7, Jul. 31, 1996 & JP 08 065005 A (Murata Mfg Co Ltd), Mar. 8, 1996, abstract.

European Search Report dated Jan. 28, 1998.

*Primary Examiner*—Seungsook Ham

*Attorney, Agent, or Firm*—Ostrolenk, Faber, Gerb & Soffen, LLP

[57] ABSTRACT

In a filter device, at least one electrically conductive leaf member is mounted on a coupling loop by soldering or the like. By bending the conductive leaf member and adjusting the bending angle, the number of magnetic lines of force to be blocked, that is, the degree of magnetic coupling, is controlled. Therefore, when the mounting position of the leaf member is predetermined, the parameter of adjustment can be limited to the bending angle, and the adjustment is thereby facilitated.

6 Claims, 7 Drawing Sheets

FILTER DEVICE HAVING A DIELECTRIC RESONATOR AND A COUPLING LOOP WITH ADJUSTABLE COUPLING BETWEEN THE DIELECTRIC RESONATOR AND THE COUPLING LOOP

BACKGROUND OF THE INVENTION

1. Field of the Invention

The present invention relates to a filter device, and more particularly, to a microwave filter using a TM (transverse magnetic) multiple-mode resonator.

2. Description of the Related Art

In a conventional filter device, an input-output coupling loop 51 located on a metal panel 52, as shown in FIG. 10, has been used in order to electromagnetically couple a TM multiple-mode resonator and an input-output electrode. The metal panel 52 is formed of a metal having a high electrical conductivity such as copper or brass. The coupling loop 51 is also formed of a metal having a high electrical conductivity such as copper or brass, and fixed on the metal panel 52 by soldering or the like. Signals are transmitted to the coupling loop 51 through an inner conductor 502 of a coaxial cable 501. An outer conductor 503 of the coaxial cable 501 is connected to an earth electrode 504 formed on the metal panel 52. The coupling loop 51 may be formed of wire. The metal panel 52 is attached to a dielectric resonator 53 as shown in FIG. 11. The degree of electromagnetic coupling between dielectric columns in the dielectric resonator 53 and the coupling loop 51 is controlled by adjusting the position of the coupling loop 51 (see FIG. 12), or by changing the shape of the coupling loop 51 (see FIG. 13).

However, the above-mentioned prior art has the following problems.

Since the coupling loop 51 is usually fixed on the metal panel 52 by soldering, it is not always easy to change the position thereof. Moreover, when pressure is applied to the coupling loop 51 so as to change the shape thereof, the bonding force of the solder between the coupling loop 51 and the metal panel 52 sometimes weakens.

When a plurality of dielectric resonators 53 are prepared and metal panels 52 are respectively attached thereto, if coupling loops 51 on the metal panels 52 are each formed of wire, it is difficult to equalize the degrees of coupling between the dielectric resonators 53 and the respective coupling loops 51 because it is difficult to give the same shape to all the wires. This results in low productivity in attaching the metal panels 52 to the dielectric resonators 53.

The dielectric resonator 53 comprises two dielectric columns 601 and 602. When the dielectric resonator 53 is operated as a TM multiple-mode resonator, electromagnetic field distributions respectively inherent in the dielectric columns 601 and 602 arise on the peripheries thereof, and the degrees of coupling between the dielectric columns 601 and 602 and the coupling loop 51 vary according to the electromagnetic field distributions. If the shape of the loop 51 is changed in a conventional manner, the degrees of coupling between the dielectric columns 601 and 602 and the coupling loop 51 are both changed thereby, so that it is difficult to separately change the degree of coupling between the loop 51 and the dielectric column 601 and the degree of coupling between the loop 51 and the dielectric column 602.

SUMMARY OF THE INVENTION

Accordingly, it is an object of the present invention to provide a filter device that is able to separately adjust the respective degrees of coupling between a coupling loop and corresponding dielectric columns for constituting a dielectric resonator, and that is excellent in its mass productivity.

In order to achieve the above object, according to an aspect of the present invention, a filter device comprise a dielectric resonator and a magnetically coupled coupling loop for input and output of signals, wherein a conductive member for adjusting the degree of magnetic coupling between the dielectric resonator and the coupling loop is mounted on the coupling loop.

The use of such a conductive member serving as a means for adjusting the degree of coupling makes it possible to reduce the pressure to be applied in adjustment. Furthermore, if the mounting position of the conductive member is predetermined, the parameter of adjustment can be limited only to the bending angle of the conductive member. Still furthermore, after the adjustment of one resonator is finished, subsequent resonators can be adjusted based on the bending angle of the conductive member in the previous adjustment, which increases mass productivity.

In the filter device of the present invention, the conductive member serving as the coupling degree adjusting means may be formed integrally with the coupling loop.

This eliminates the need for a step of externally mounting the conductive member by soldering or the like, and the manufacturing process is thereby simplified.

Furthermore, in the filter device of the present invention, the dielectric resonator may be a TM mode resonator.

Still furthermore, the filter device of the present invention may be provided with a means for separately adjusting the degrees of coupling of dielectric columns in the TM mode resonator to the coupling loop.

Since the degrees of coupling of the dielectric columns to the coupling loop can be adjusted separately, it is unnecessary to consider the influence of the adjustment for one dielectric column upon the degrees of coupling of other dielectric columns, and every adjustment operation is thereby facilitated.

DESCRIPTION OF THE PREFERRED EMBODIMENTS

The preferred embodiments of the present invention will be described below with reference to the attached drawings.

First Embodiment

Figure 1:
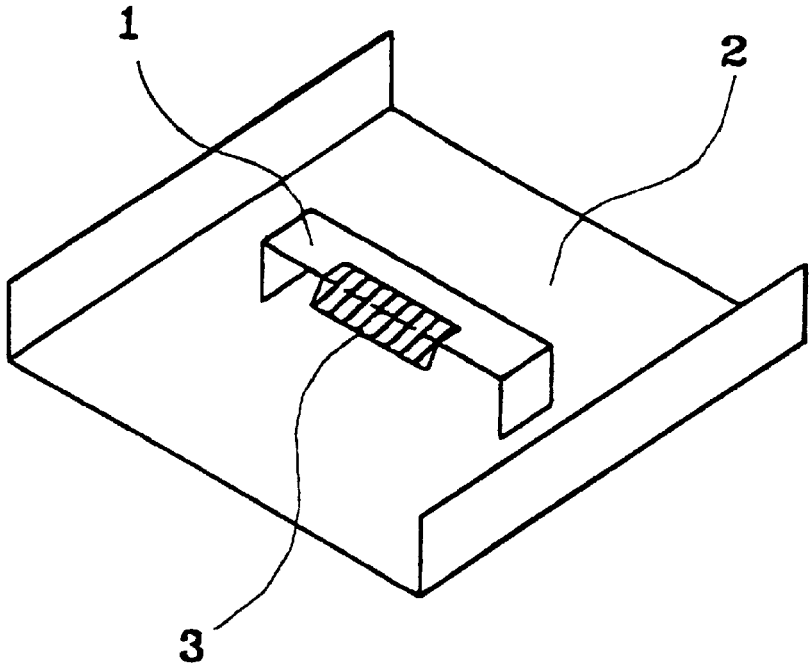
FIG. 1 is a perspective view of part of a filter device according to a first embodiment of the present invention.

FIG. 1 is a perspective view of part of a filter device according to a first embodiment of the present invention, and illustrates only a metal panel 2 in the filter device which has a coupling loop 1 mounted thereon. A dielectric resonator and the like are left out of FIG. 1 for easy view of a section for adjusting the degree of magnetic coupling.

The metal panel 2 fixes a dielectric resonator so as to form a filter device, and also serves to shield the dielectric resonator. Furthermore, the metal panel 2 serves as a substrate on which a coaxial connector for input and output of external signals is mounted. The metal panel 2 is made of various types of well-known metals such as copper and brass.

Mounted on a surface of the metal panel 2 opposed to dielectric columns is the coupling loop 1 for magnetically coupling an external signal and the dielectric columns. The coupling loop 1 is fixed on the metal panel 2 by soldering or the like, and electrically connected to a coaxial connector attached to the rear surface of the metal panel 2 via a through hole formed on the metal panel 2, or the like. Furthermore, the coupling loop 1 forms a ring with the metal panel 2 so as to form a closed loop capable of obtaining a strong magnetic coupling, and made of various types of well-known metals such as copper and brass. Although the coupling loop 1 mounted on the metal panel 2 is formed of a metal plate bent into an angular-U shape in FIG. 1, it may be made of metals formed in various shapes, such as wire. Furthermore, the coupling loop 1 may be mounted at any position that can provide magnetic coupling, and the mounting position thereof is not limited to the position shown in FIG. 1.

A conductive leaf member 3 is fixed on the coupling loop 1 by soldering. The leaf member 3 is soldered so that it can be bent to adjust the degree of magnetic coupling. By adjusting the bending angle of the conductive leaf member 3, the degree of magnetic coupling between the coupling loop 1 and the dielectric columns for constituting the dielectric resonator is adjusted. Although the conductive leaf member 3 shown in FIG. 1 is formed of a thin metal plate, it may be formed of metal wires arranged in one plane, metal mesh, metal foil, or the like. Moreover, although the leaf member 3 is located on the coupling loop 1 in this embodiment, the mounting position thereof is not limited to that position. In other words, the leaf member 3 is placed into a position where it can adjust the degree of magnetic coupling, and the position may be arbitrarily set, for example, on the metal panel 2. Furthermore, although the conductive leaf member 3 is fixed by soldering in this embodiment, the fixing may be conducted by any bonding method that allows electrical connection to the coupling loop 1, the metal panel 2, and the like.

Next, magnetic coupling using the coupling loop 1 will be described.

First, a signal transmitted from the outside through a transmission line, such as a coaxial cable, is sent to the coupling loop 1 through the connector. The signal sent to the coupling loop 1 is converted into a magnetic component, and a magnetic field is produced around the coupling loop 1. The produced magnetic field and the dielectric columns are magnetically coupled, thereby performing signal transmission. (The coaxial cable and the connector are not shown). In this embodiment, the conductive leaf member 3 is positioned so as to block magnetic lines of force which form the aforesaid magnetic field. Changing the bending angle of the leaf member 3 adjusts the number of magnetic lines of force, and therefore adjusts the degree of magnetic coupling.

Although a TM single-mode resonator is intended to be used as a dielectric resonator in the filter device of this embodiment, other resonators, for example, a TM multiple-mode resonator may be used. However, in this case, it is difficult to separately adjust the degrees of coupling of the dielectric columns which constitute the resonator.

Second Embodiment

Figure 2:
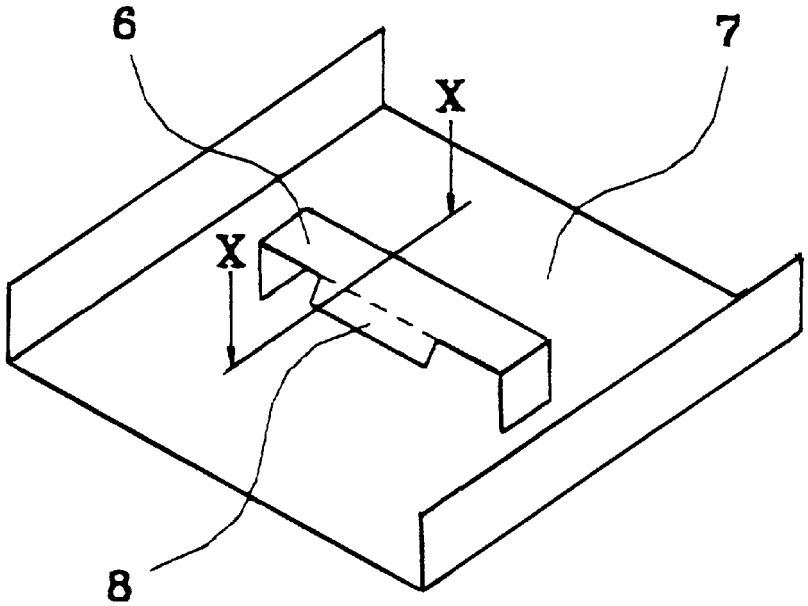
FIG. 2 is a perspective view of part of a filter device according to a second embodiment of the present invention.

FIG. 2 is an exploded perspective view of a filter device according to a second embodiment of the present invention. A dielectric resonator and the like are left out of FIG. 2 as in FIG. 1.

Figure 3:
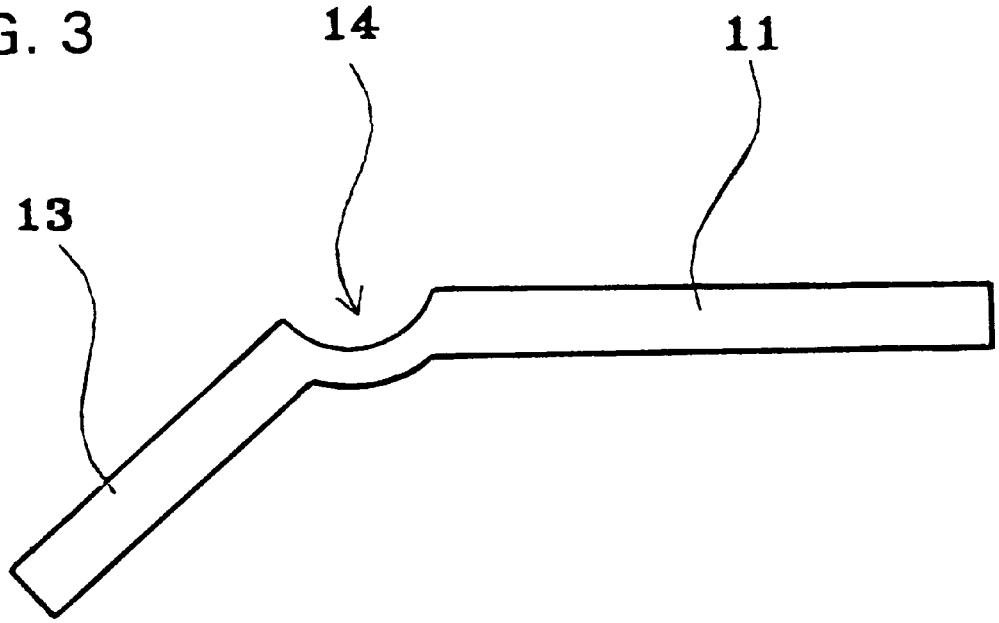
FIG. 3 is a cross-sectional view of a coupling loop in the filter device of the second embodiment, taken along the line X—X in FIG. 2.
Figure 4:
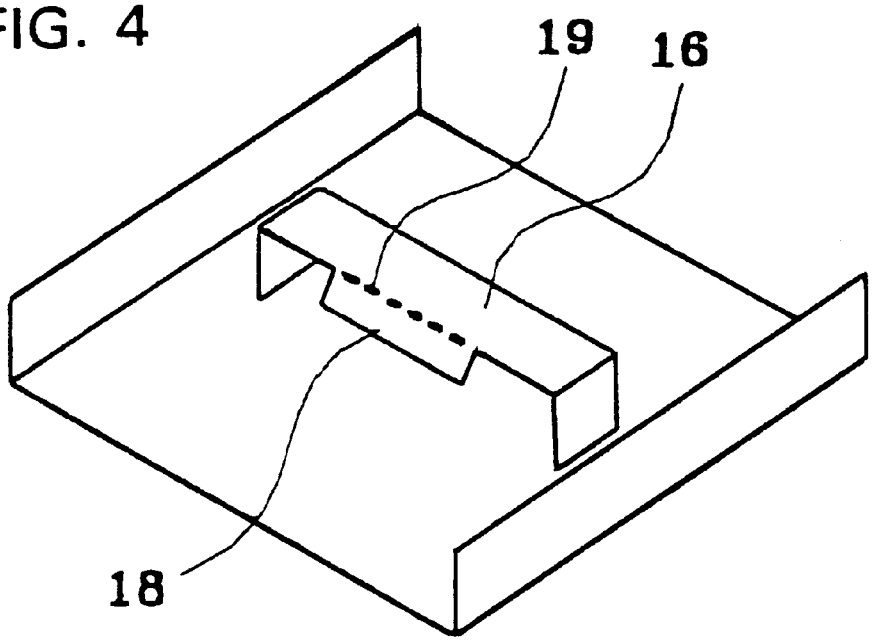
FIG. 4 is a perspective view showing a modification of the coupling loop in the filter device of the second embodiment.

A coupling loop 6 for magnetically coupling an external signal and dielectric columns is mounted on a surface of a metal panel 7 opposed to the dielectric columns. The coupling loop 6 is integrally provided with an adjusting plate 8 for adjusting the degree of the magnetic coupling. Although the coupling loop 6 and the adjusting plate 8 may be made of any material having electrical conductivity, it is preferable to determine the material and thickness thereof so that they have a hardness suitable for adjustment by means of the adjusting plate 8. Furthermore, in order to ease the adjustment by the adjustment plate 8, a groove 14 shown in FIG. 3 or perforations 19 shown in FIG. 4 may be formed at a bending portion of the adjusting plate 8.

As mentioned above, since the means for adjusting the degree of magnetic coupling is formed integrally with the coupling loop 6, it is unnecessary to externally mount a separate adjusting member, which simplifies the manufacturing process.

In other respects, the filter device of this embodiment is not different from the filter device of the first embodiment. For example, the metal panel 7 may be made of various types of well-known metals, and the coupling loop 6 may be placed arbitrarily at any position that provides magnetic coupling.

Third Embodiment

Figure 5:
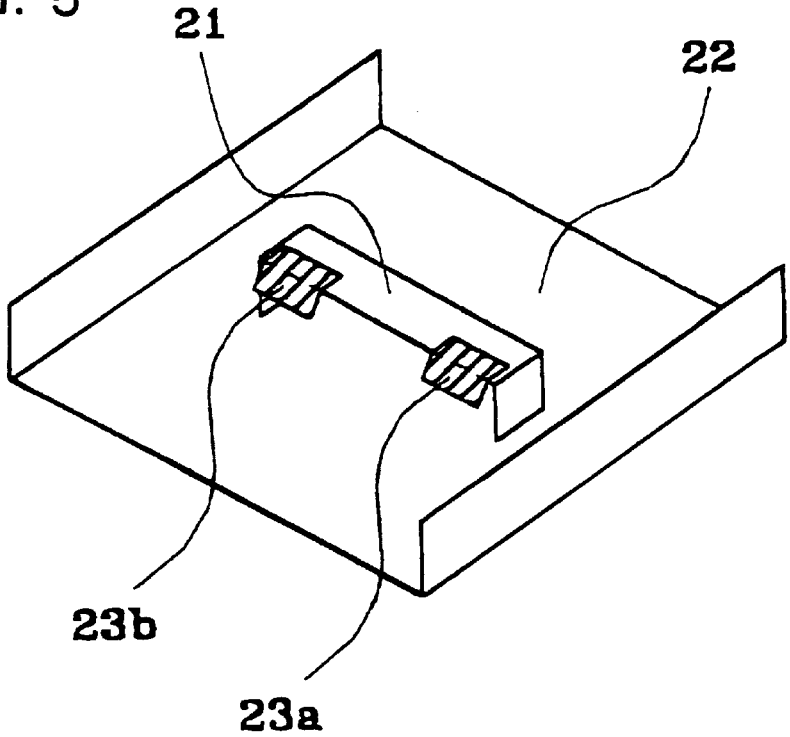
FIG. 5 is a perspective view of a coupling loop in a filter device according to a third embodiment of the present invention.

FIG. 5 is an exploded perspective view of a filter device according to a third embodiment of the present invention. In FIG. 5, the illustration of a dielectric resonator and the like is also omitted similarly to FIG. 1 for the first embodiment.

In the filter device using a TM multiple-mode resonator, a metal panel 22 is provided with adjusting means for separately adjusting the degrees of coupling of dielectric columns which constitute the resonator.

Figure 6:
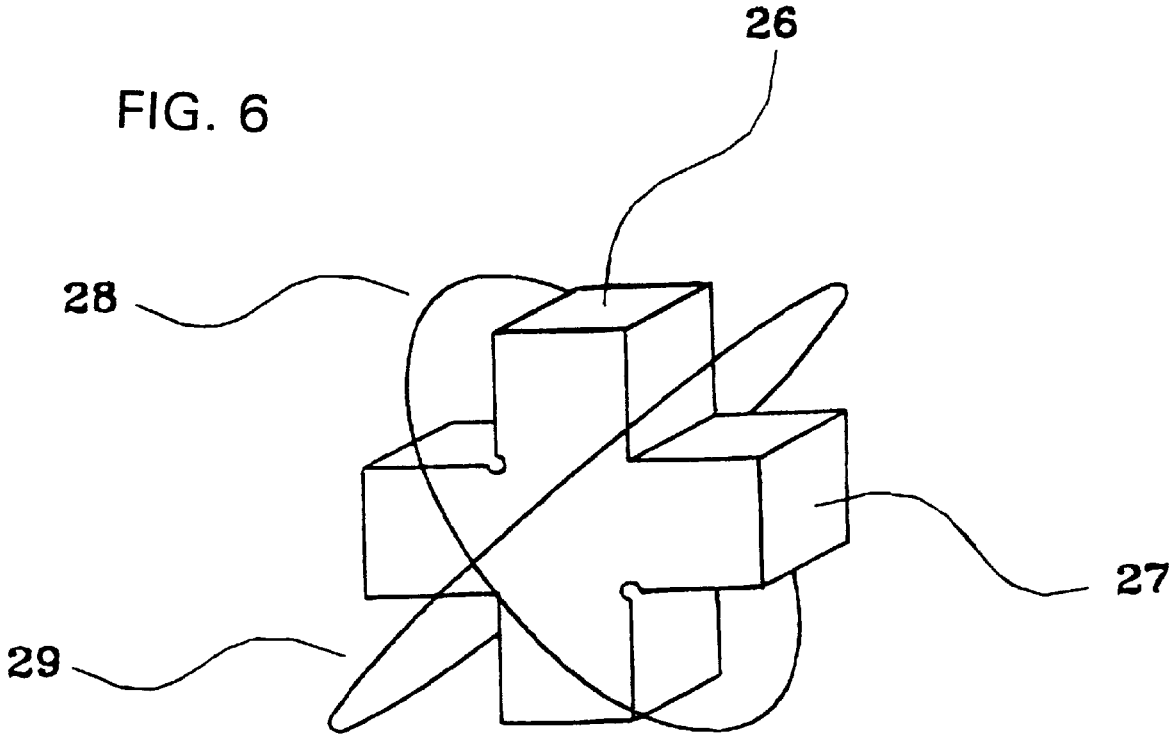
FIG. 6 is a perspective view showing a resonant space formed in a TM double-mode resonator.
Figure 7:
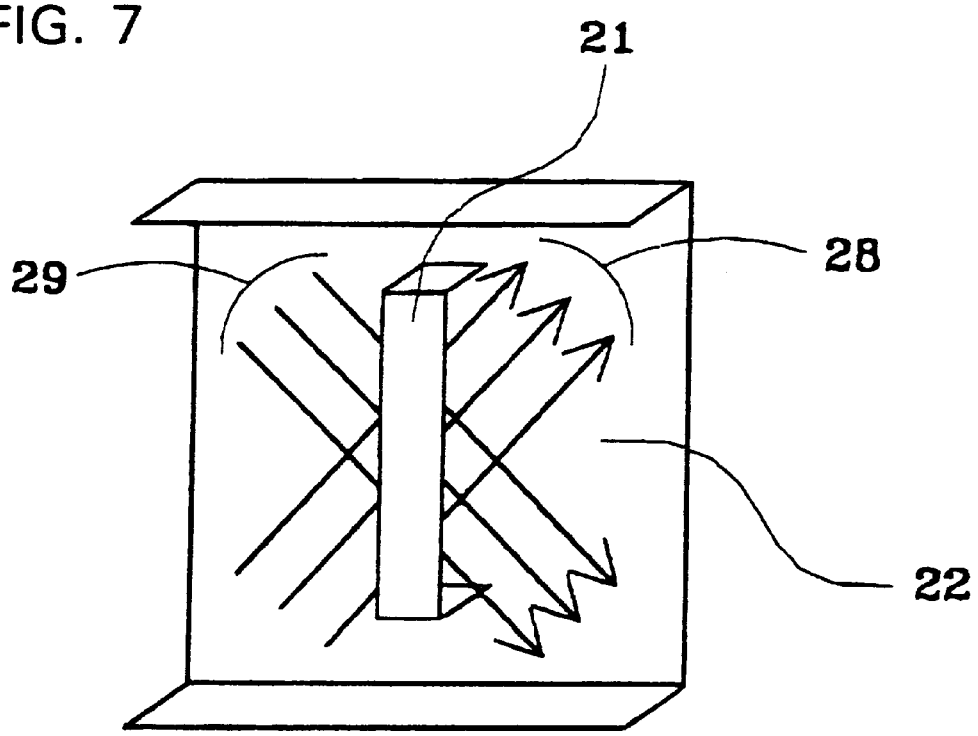
FIG. 7 is a perspective view showing the coupling state between the resonant space shown in FIG. 6 and a coupling loop.
Figure 13:
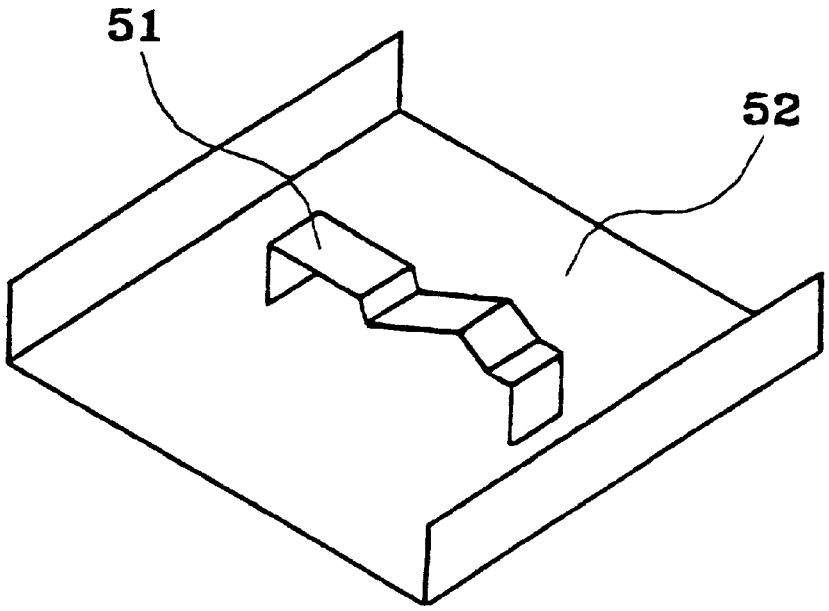
FIG. 13 PRIOR ART
FIG. 13 is a perspective view showing another adjustment method of the conventional filter device.
Figure 8:
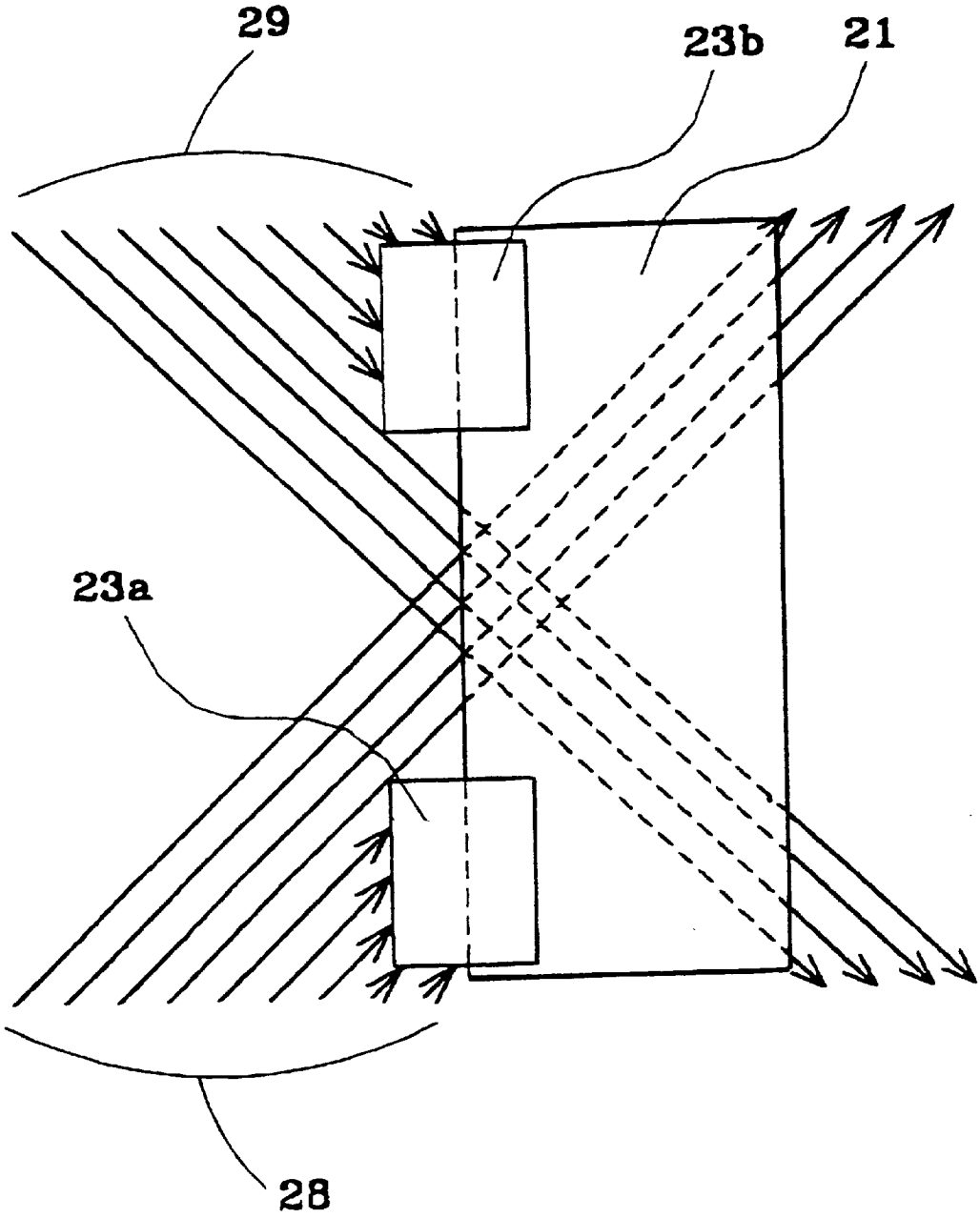
FIG. 8 is an enlarged plan view of the coupling loop in the filter device according to the third embodiment.

The case in which a TM double-mode resonator is used as a dielectric resonator will be described below. FIG. 6 shows conceptually the magnetic field produced in a TM double-mode resonator in which dielectric columns intersect at right angles. Magnetic lines of force 28 and 29 pointing in two different directions are formed by two dielectric columns 26 and 27. At this time, the magnetic lines of force 28 and 29 pass through a coupling loop 21 in the directions shown in FIG. 7. By mounting conductive leaf members 23*a* and 23*b* at positions shown in FIG. 8, it allows the magnetic lines of force 28 and 29 pointing in different directions to be blocked separately. Therefore, for example, the degree of coupling between the magnetic lines 28 and the coupling loop 21 can be controlled by adjusting the leaf member 23*a*, with little influence upon the degree of coupling between the magnetic lines of force 29 and the coupling loop 21.

Although the conductive leaf members 23*a* and 23*b* are used as coupling degree adjusting means in this embodiment, it is needless to say that an adjusting plate integrally formed with the coupling loop as mentioned in the second embodiment may be used. Furthermore, it is not necessary to place the coupling degree adjusting means on the coupling loop 21, and it may be placed at any position that allows the degree of coupling of magnetic lines of force to be adjusted, for example, on the metal panel 22.

Fourth Embodiment

Figure 9:
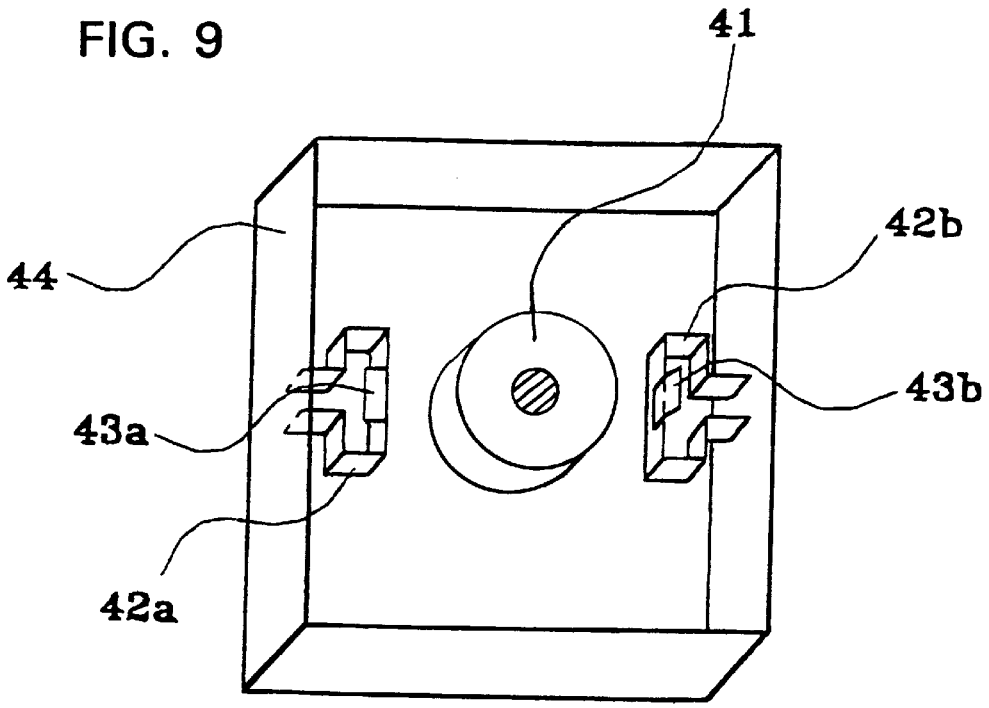
FIG. 9 is a perspective view of part of a filter device according to a fourth embodiment of the present invention.
Figure 10:
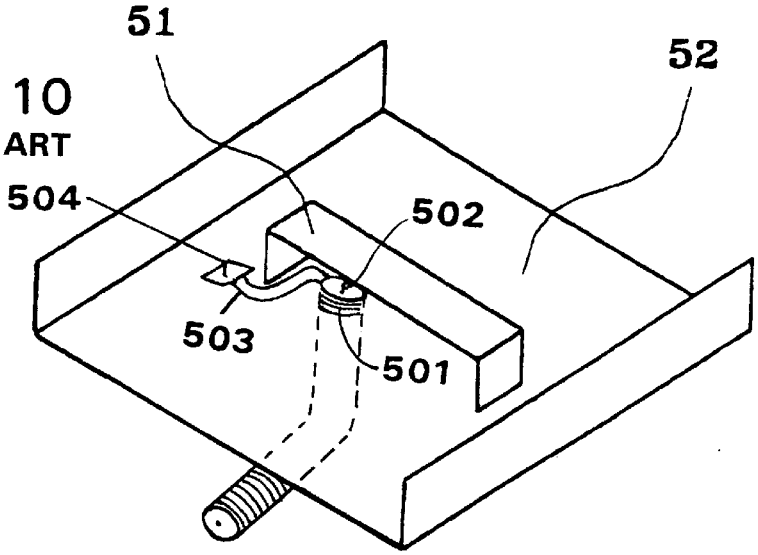
FIG. 10 PRIOR ART
FIG. 10 is a perspective view of part of a conventional filter device.
Figure 11:
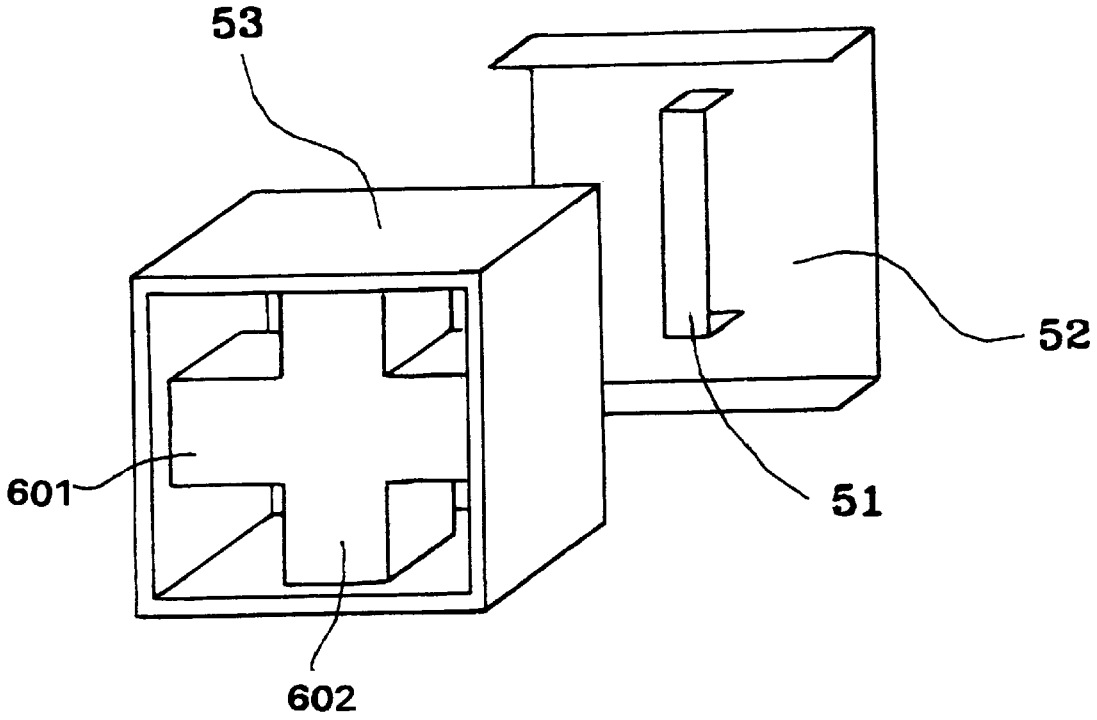
FIG. 11 PRIOR ART
FIG. 11 is an exploded perspective view showing the positional relationship among a metal panel, a coupling loop and a dielectric resonator in the conventional filter device.
Figure 12:
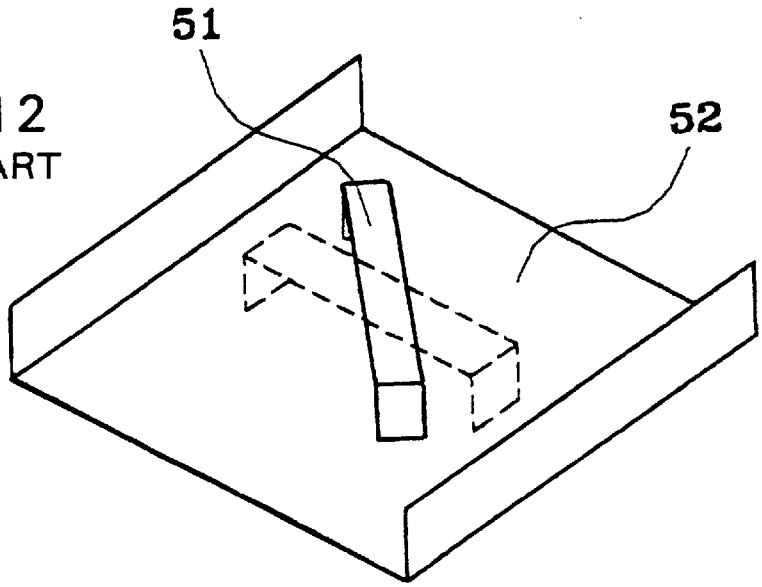
FIG. 12 PRIOR ART
FIG. 12 is a perspective view showing an adjustment method of the conventional filter device.

FIG. 9 is an exploded perspective view of a filter device according to a fourth embodiment of the present invention, and a metal cover for shielding a filter is left out of FIG. 9 for easy view of the inside of the filter device.

The filter device of the fourth embodiment uses a TE (transverse electric) mode resonator as a dielectric resonator. Signals transmitted from a transmission line, such as a coaxial cable, to a coupling loop 42*a* through a connector are converted into magnetic components and magnetically coupled with a resonator 41. Only necessary signals are sent again to a coupling loop 42*b* by magnetic coupling. (The coaxial cable and the connector are not shown.) In order to adjust the degree of magnetic coupling performed in these processes, conductive leaf members 43*a* and 43*b* are provided.

As mentioned above, the means for adjusting the magnetic lines of force according to the present invention is also applicable to the filter device using the TE mode resonator. This fourth embodiment is not different from the first and second embodiments except in that a TE mode resonator is used as a resonator.

As described above, according to the filter device of the present invention, if the shape and mounting position of a coupling degree adjusting means, such as a conductive leaf member or an adjusting plate integrally formed with the coupling loop, are predetermined, the parameter of adjustment can be limited only to the bending angle of the adjusting means, which facilitates the adjustment operation. Moreover, after the adjustment of one resonator is finished, subsequent resonators can be adjusted based on the bending angle of the adjusting means in the previous adjustment, which increases mass productivity.

Furthermore, when the coupling degree adjusting means is integrally formed with the coupling loop, there is no need to externally mount a separate conductive leaf member for adjustment by soldering or the like, and the manufacturing process is thereby simplified.

Still furthermore, since it is possible to separately adjust the degrees of coupling of the dielectric columns which constitute the dielectric resonator, there is no need to consider the influence of adjustment to one dielectric column upon the degree of coupling of other dielectric columns, and the adjustment is thereby facilitated.

What is claimed is:

1. A filter device comprising:

a TM multiple-mode dielectric resonator comprising a plurality of dielectric columns; and a coupling loop, magnetically coupled to said dielectric resonator by magnetic lines of force pointing in two directions, for input and output of signals to said filter device;

said filter device having a plurality of adjusting sections for adjusting the magnetic coupling between said dielectric resonator and said coupling loop;

wherein each of said adjusting sections corresponds to a respective one of said two directions and independently adjusts said magnetic coupling due to said magnetic lines of force pointing in said respective one of said two directions.

2. A filter device according to claim 1, wherein each said coupling degree adjusting section comprises a conductive member connected to said coupling loop.

3. A filter device according to claim 1, wherein said coupling loop has a substantially flat portion defining a plane, and each of said adjusting sections extends away from said coupling loop at an angle with respect to said plane.

4. A filter device according to claim 3, wherein each said adjusting section comprises a conductive member fixed to said coupling loop.

5. A filter device according to claim 4, wherein said conductive member is fixed to said coupling loop with a conductive bonding material.

6. A filter device according to claim 2, wherein said conductive member is fixed to said coupling loop with a conductive bonding material.

* * * * *